United States Patent [19]

Pall et al.

[11] Patent Number: 4,534,388

[45] Date of Patent: Aug. 13, 1985

[54] DISPERSION SYSTEM AND METHOD

[75] Inventors: David B. Pall, Roslyn Estates; Peter J. Degen, Huntington; John Mischenko, III, Amityville, all of N.Y.

[73] Assignee: Pall Corporation, Glen Cove, N.Y.

[21] Appl. No.: 501,889

[22] Filed: Jun. 7, 1983

[51] Int. Cl.[3] ..... B65B 3/04

[52] U.S. Cl. ..... 141/1; 141/98; 141/392; 53/113; 137/843; 138/37; 138/178; 239/104; 210/252; 210/295; 210/488; 241/46.06

[58] Field of Search ..... 210/488, 252, 295; 241/46.06, 46.11; 53/113-122, 513-530; 141/11, 69, 70, 98, 1, 392, 89-92; 137/843-860; 239/104-123; 138/37, 178

[56] References Cited

U.S. PATENT DOCUMENTS

| | | | |
|---|---|---|---|
| 188,201 | 3/1877 | Snowden . | |
| 890,121 | 6/1908 | Brenner et al. . | |
| 1,996,159 | 4/1935 | Kittredge . | |
| 2,998,198 | 8/1961 | Young . | |
| 3,164,164 | 1/1965 | Pall et al. . | |
| 3,262,563 | 7/1966 | Pall . | |
| 3,262,564 | 7/1966 | Pall et al. . | |
| 3,262,567 | 7/1966 | Pall et al. . | |
| 3,436,346 | 4/1969 | Westover et al. . | |
| 3,442,290 | 5/1969 | Phillips . | |
| 3,506,644 | 4/1970 | Parker . | |
| 3,646,957 | 3/1972 | Allen | 137/525 |
| 3,667,688 | 6/1972 | Iannicelli | 241/1 |
| 3,817,891 | 6/1974 | Keas . | |
| 3,905,122 | 9/1975 | Ohshima et al. | 34/17 |
| 4,113,688 | 9/1978 | Pearson . | |
| 4,212,748 | 7/1980 | Ferrell et al. . | |
| 4,231,882 | 11/1980 | Elphingstone et al. . | |

FOREIGN PATENT DOCUMENTS

| | | |
|---|---|---|
| 921690 | 2/1973 | Canada . |
| 1011687 | 7/1957 | Fed. Rep. of Germany . |
| WO81/00525 | 8/1980 | PCT Int'l Appl. . |
| 528019 | 10/1940 | United Kingdom . |
| 853618 | 11/1960 | United Kingdom . |
| 1125721 | 8/1968 | United Kingdom . |
| 2035817 | 6/1980 | United Kingdom . |

*Primary Examiner*—Houston S. Bell, Jr.

*Attorney, Agent, or Firm*—Leydig, Voit and Mayer, Ltd.

[57] ABSTRACT

A self-cleaning system and method for dispersing aggregates in a fluid medium is provided. The system is comprised of first and second members operatively associated to form an internal chamber and having an inlet to the chamber for admitting the fluid to be treated. At least one of the members is biased toward the other whereby the introduction of a fluid medium to be treated into the chamber under an operating pressure in the range of from about 50 to about 1,000 psid (3.5 to 70.3 kg/cm$^2$) provides an elongated orifice between the first and second members having a transverse dimension or width of from about 1 to about 1,500 micrometers for egress of the fluid medium. As the fluid passes through the elongated orifice, aggregates contained therein are dispersed. The system is self-cleaning by virtue of the biased nature of at least one of the members toward the other, thereby providing longer onstream operation and requiring less servicing. The system can be used for treating aggregate-containing fluids such as oil well completion fluids, dispersions used in the manufacture of magnetic tape, and dispersion of particulates such as carbon black and other pigments.

36 Claims, 16 Drawing Figures

DISPERSION SYSTEM AND METHOD

TECHNICAL FIELD

This invention relates to a system and method for dispersing aggregates in fluid media. More particularly, this invention provides a self-cleaning system and method for dispersing or breaking up aggregates, thereby rendering the fluid media more uniform in composition and providing improved filterability.

BACKGROUND ART

The necessity of treating aggregates in fluid media is a problem common to a wide variety of industries. Various forms of aggregates must be dealt with and various techniques have been developed. Before discussing areas in which problems with aggregates in fluid media are encountered, certain terms used herein need to be defined.

The term "aggregate" as used herein means a mass or a body of units or parts associated—generally somewhat loosely—with one another. It includes such things as (1) gels, i.e., colloids in which the dispersed phase has combined with the continuous phase to produce a semi-solid material, (2) masses of solid particulates such as carbon black, pigments and the like in which individual particles are associated with one another to form a clump or clustered mass, and (3) masses of needle-like or elongated particles having relatively high aspect ratios which are associated with one another to form a clump or clustered mass. The latter category (3) includes needle-like materials such as metallic oxides used in the manufacture of magnetic tape.

The terms "disperse" and "dispersing" as used here with regard to the treatment of aggregates refer to the breaking up of aggregates to form smaller aggregates and in some applications the partial or substantially complete breakup of aggregates into their individual components, i.e., into the individual particles which collectively formed the aggregates.

A previously noted, the need to disperse aggregates gates in fluid media is a problem common to many industries. For example, hydroxyethylcellulose ("HEC") is widely used in oil well completion work for the economic preparation of viscosified brines, primarily to obtain plug flow during the last stages of cleaning of undesirable solid particles and gravel from the otherwise completed well. Viscosified brines are prepared by combining salts, such as alkaline and alkaline earth halides, e.g., sodium chloride and calcium bromide, with water to increase the density.

The compositions are made viscous by including a water soluble polymer, e.g., HEC. The quantity of polymer required to achieve the desired viscosity generally contains an undesirable level of gel aggregates. Gel aggregates in well completion fluids are undesirable for two principal reasons: (1) they tend to plug the filters used to clean up a completion fluid prior to its injection into a well, and (2) the gel aggregates are themselves highly deleterious to oil production if they are included in a fluid injected into the well since they tend to plug the formation. In order to obtain a useful brine or well completion fluid, then, the gel aggregates in the viscosified brine fluid must be removed and/or reduced to a fine state. This can be accomplished by filtration but the cost and time required are excessive due to rapid filter plugging Attempts have been made to reduce the gel aggregate content by other means but these have generally been accompanied by a quite large reduction in viscosity of the fluids, an undesirable side effect since the primary reason for adding the polymer is to increase the viscosity.

A system, then, capable of removing gel aggregates from such systems and/or reducing the size of gel aggregates to a fine state to alleviate filter plugging and reduce damage to oil bearing formations, particularly if that system were self-cleaning and did not substantially effect the bulk viscosity of the brine, would be highly desirable.

A second area in which aggregate formation and subsequent filter plugging causes problems is in the manufacture of high fidelity magnetic tapes and the like. Compositions used in the manufacture of such tapes generally comprise a mixture of (1) one or more metal oxides, such as oxides of chromium and iron, which typically are in the form of needle-like particles, and (2) a resin system, with this mixture dispersed in an organic liquid such as methyl ethyl ketone, toluene or the like.

Compositions of this type are prone to aggregate formation and subsequent filter plugging since the filters used are relatively fine to insure a uniform and fine level of dispersion of the metal oxide particles necessary for the manufacture of high quality, high fidelity tapes. Concomitantly, they are more susceptible to plugging. Typically, relatively expensive, porous stainless steel filters are used. The replacement cost when rapid plugging occurs, necessitating quick change-out, is quite high. The difficulties in filtering these types of systems are generally known. A filter with fine pores plugs rapidly although the product (effluent) is satisfactory. Alternatively, a more coarse filter has a longer on-stream life but the resulting product is of lesser quality. To achieve both the desired economic life and an acceptable effluent is difficult. Compounding the problem, the resin system itself can contribute to the manufacture of an inferior product due to insoluble crosslinked polymeric gel aggregates formed during the normal manufacturing process for resins. If not removed, these gel-based aggregates, as well as oxide-based aggregates, interfere with the reproductive fidelity of magnetic tapes by creating background noise due to the resulting rough surface of the tape. A dispersion system then operating ahead of these filters to remove such aggregates and/or reduce their size would extend the life of the fine filters required and enhance the economics of the process.

In addition to the need for a high and uniform level of dispersion in such compositions, it is also required that destruction or breakdown of the individual needle-like particles, typically having relatively high aspect ratios, e.g., 10–15 to 1, be avoided. Accordingly, in both the initial formation of the suspension or dispersion used in magnetic tape manufacture and in the subsequent treatment of such dispersions, a self-cleaning system having the capability of both initially forming a uniform dispersion and subsequently insuring that it remain substantially free of aggregates would be highly desirable.

Another application in which the uniform dispersion of solid particulate matter in a fluid medium is desirable is in the dispersion of pigments such as carbon black and the like where the fine particles tend to agglomerate. Many compositions where solid particulates, such as carbon black and other pigments, are used also contain high molecular weight binders or thickeners which commonly contain undesirable gel-like aggregates. The system and method of this invention serve to disperse the solid particulate aggregates without substantial adverse effect on the properties of the binder or thickener. Indeed, the system and method of this invention also serve to reduce the undesirable gel-like aggregates commonly present in such systems. Typically, these compositions are used as paint bases and, in general, the higher the level of dispersion, the more effective a given weight of pigment, i.e., the more finely dispersed the pigment, the less that is required.

There are many other industries and applications where there is a need for an ability to provide a high and uniform level of dispersion of aggregates in a fluid, for example, in the spinning of fibers from polymers where gels can cause fiber breakage during drawing of the fibers and, similarly, in film casting and extrusion where gels can cause "fisheyes" due to local thickening of the film or, conversely, may cause holes in the film.

As described hereinafter, the system and method of this invention provide a straightforward, efficient and clean technique for dispersing aggregates in fluid media and, in large measure, overcome the problems heretofore only partially solved by prior art techniques.

DISCLOSURE OF THE INVENTION

A self-cleaning system and method for dispersing aggregates in a fluid medium is provided. The system is comprised of first and second members operatively associated to form an internal chamber and having an inlet to the chamber for admitting the fluid to be treated. At least one of the members is biased toward the other whereby the introduction of a fluid medium to be treated into the chamber under an operating pressure in the range of from about 50 to about 1,000 psid (3.5 to 70.3 kg/cm$^2$) provides an elongated orifice between the first and second members for egress of the fluid medium. As the fluid passes through the elongated orifice, aggregates contained therein are dispersed thereby forming an aggregate-dispersed fluid medium. The elongated orifice formed between the first and second members under the operating pressure, of the system has a minimum length of about 3 inches (7.6 cm) and ratio of the length of the elongated orifice to its transverse dimension or width of at least about 100:1 or greater, more preferably 200:1 or greater. The transverse dimension or width of the elongated orifice under operating pressures of from about 50 to about 1,000 psid (3.5 to 70.3 kg/cm$^2$) is in the range of from about 1 to about 1,500 micrometers, more preferably from about 10 to about 1,250 micrometers.

A preferred embodiment of the system is comprised of a Belleville washer resiliently biased and in operating relationship with a Belleville washer seat which is, in turn, mounted on a base member. The base member has an opening therein for the admission of fluid to be treated and the system is held in operating relation with the Belleville washer resiliently biased toward the Belleville washer seat by a centrally disposed screw secured at its lower end to the base member.

In operation, fluid to be treated enters the base member and flows to a centrally disposed annular chamber surrounding the centrally disposed screw in the base member and then through an inlet into a centrally disposed annular chamber in the Belleville washer seat, following which it passes through multiple channels into an annular chamber defined by the Belleville washer and the Belleville washer seat and then flows out the annular, elongated orifice formed between the outer edge of the Belleville washer and the Belleville washer seat by the pressure of the fluid. As the fluid is forced through the elongated orifice, aggregates present in the fluid are broken up, thereby providing a more uniformly dispersed fluid composition. The enhanced dispersion and reduction in size of the aggregates can be accomplished without substantial degradation of the dissolved polymer phase, which, when it occurs, can result in a substantial reduction in the bulk viscosity of the fluid.

As noted above, the systems of this invention are self-cleaning, thereby providing longer onstream operation and requiring less servicing. Because at least one of the first and second members is biased toward the other, any material in the fluid being treated which does not immediately pass through the elongated orifice at the specified operating pressure will temporarily reduce the available cross sectional area available for passage of fluid through the orifice and, if not broken down by the passage of fluid around it, will lead to a pressure buildup ultimately resulting in a temporary increase in the transverse dimension or width of the elongated orifice, allowing the particle to pass through the orifice. That is, in operation, the system cleans itself by virtue of the biased, rather than fixed, relationship between the first and second members defining the orifice.

In an alternative preferred embodiment of the system, a series of Belleville washers alternate with a series of Belleville washer seats in a stacked, repeating configuration to form a system with increased throughput capacity.

The method of this invention comprises passing the aggregate-containing fluid through the system of this invention at a pressure of from about 50 to about 1,000 psid (3.5 to 70.3 g/cm$^2$) to disperse the aggregates in the fluid. Depending on the particular fluid being treated and the nature of the aggregates therein, the fluid may thereafter be filtered prior to use, e.g., injection into a well or in magnetic tape manufacture. As discussed in detail hereinafter, particular applications are preferably carried out under more restricted operating conditions.

BEST MODE FOR CARRYING OUT THE INVENTION

Figure 1:
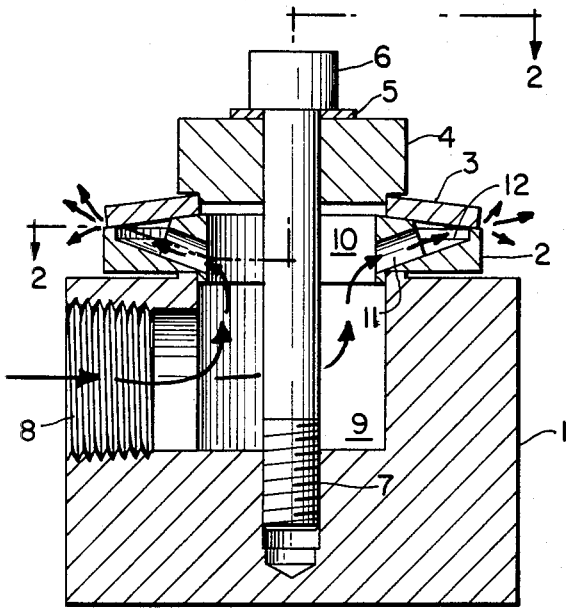
FIG. 1 is an elevation view in cross section of one embodiment of the system of the subject invention wherein a single, resiliently biased member (Belleville washer) is operatively associated with a seat mounted on a base.
Figure 2:
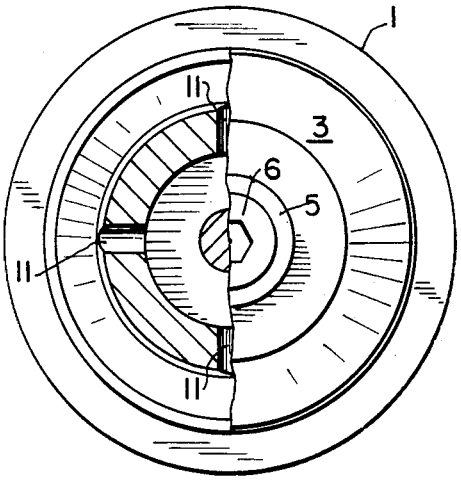
FIG. 2 is a plan view in partial cross section taken along line 2—2 or FIG. 1.
Figure 3:
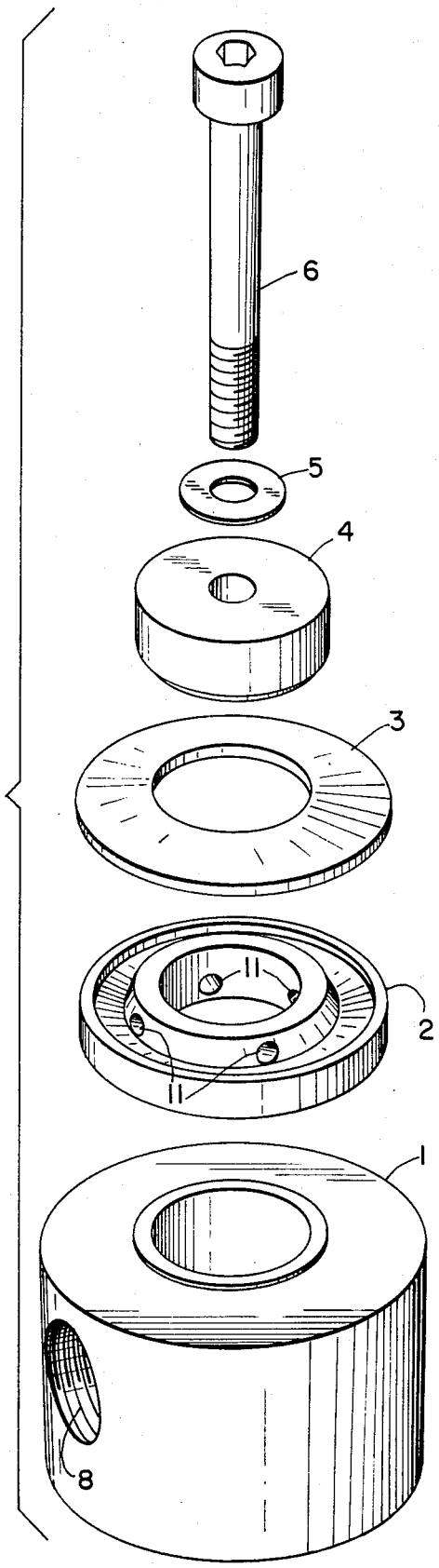
FIG. 3 shows the component parts of the embodiment illustrated in FIGS. 1 and 2 in exploded perspective form.

The embodiment illustrated in FIGS. 1–3 comprises a base 1, a Belleville washer seat 2 mounted on a raised portion on the top of the base 1, a Belleville washer 3 seated in the Belleville washer seat 2, a top closure member 4 sealingly engaging the inner and uppermost portion of the Belleville washer which is positioned with its concave side facing downward, and a washer 5 on a screw 6 with the washer, 5 positioned between the top closure member 4 and the underside of the head of screw 6.

The threaded lower end of the centrally disposed screw 6 engages an internally threaded hole 7 in the base 1 and secures the structure in the desired configuration, as shown in FIG. 1, with the Belleville washer 3 resiliently biased toward the Belleville washer seat 2 and with its concave side facing the washer seat 2. By adjusting the torque on the screw and controlling the physical characteristics of the Belleville washer, the force required to resiliently deform the Belleville washer and open an elongated annular orifice between the outer lower edge of the Belleville washer and the outer upper surface of the Belleville washer seat can be controlled to provide an orifice of the desired size at a specified operating pressure.

In operation, an aggregate-containing fluid under pressure enters the inlet opening 8 following the path shown by the arrows in FIG. 1, flows into the annular, centrally disposed chamber 9 in the base 1 surrounding the screw shaft, and then flows upward into the annular, centrally disposed chamber 10 in the Belleville washer seat 2. Chambers 9 and 10, while separately defined here, can be viewed as a single, centrally disposed annular chamber surrounding the screw 6. From the chamber 10 the fluid passes through the four channels 11 in the Belleville washer seat 2 into an annular chamber 12 formed between the Belleville washer seat and the Belleville washer 3.

In operation, the aggregate-containing fluid is supplied to the system at a pressure sufficient to resiliently deform the Belleville washer to provide the elongated annular orifice having the desired substantially uniform transverse dimension so that the fluid is subjected to substantially uniform aggregate-dispersing forces as it exits the system through the elongated annular orifice as shown by the arrows in FIG. 1.

Figure 4:
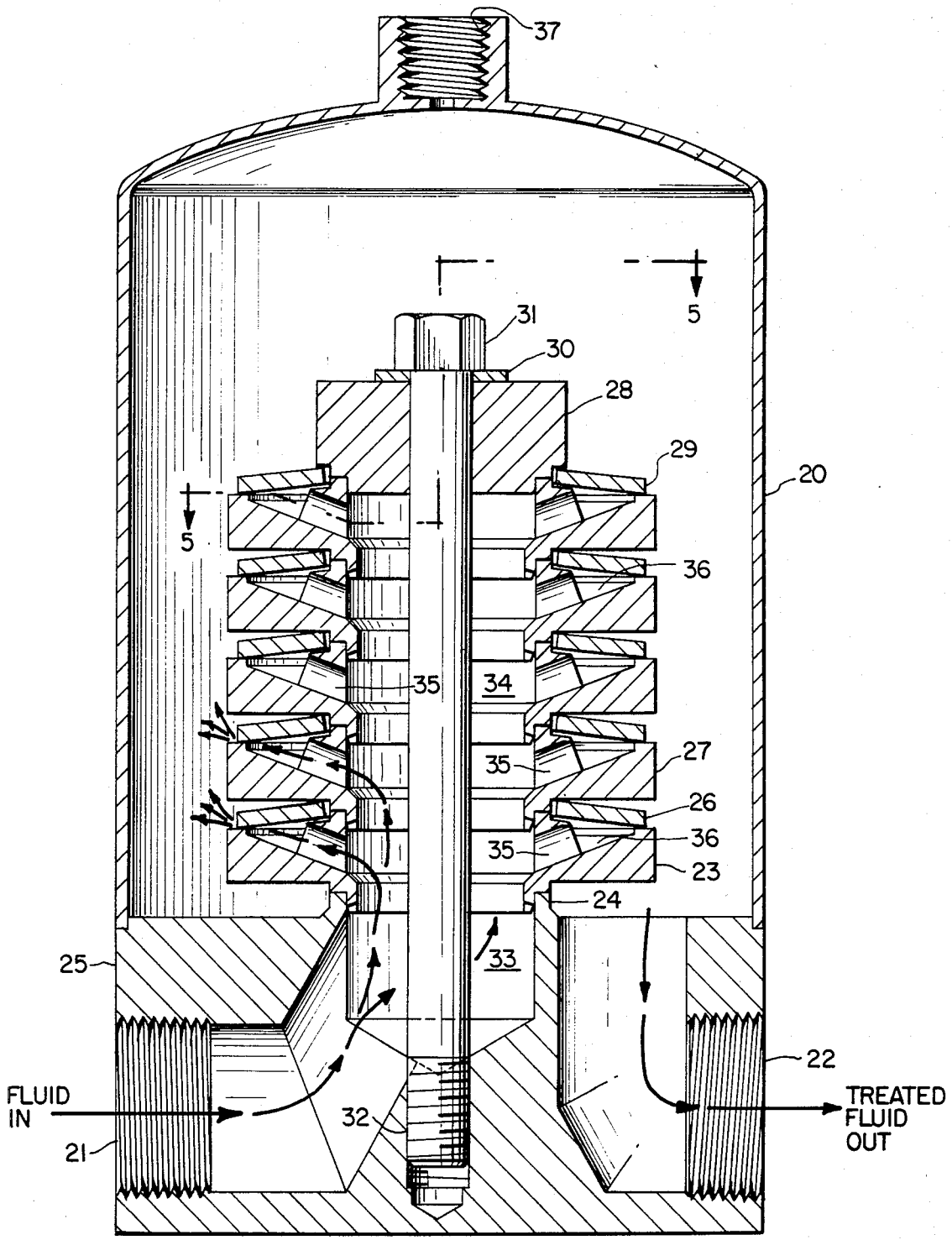
FIG. 4 is an elevation view in cross section of a second embodiment of the system of the subject invention wherein resiliently biased members (Belleville washers) alternate with seat members (Belleville washer seats) in a stacked, repeating configuration contained in a housing.
Figure 5:
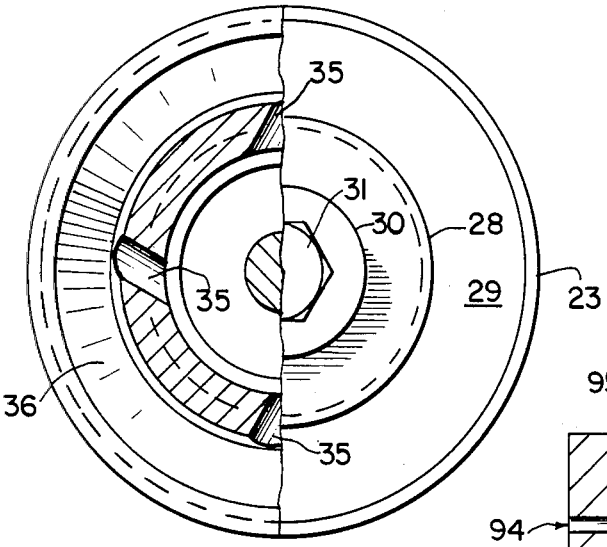
FIG. 5 is a plan view in partial cross section taken along line 5—5 of FIG. 4.

Another preferred embodiment of the subject invention is illustrated in FIGS. 4 and 5. This embodiment comprises a housing 20 having an inlet 21 and an outlet 22 located in the base of the housing 20. In a manne: similar to that of the system described in FIGS. 1 to 3, a Belleville washer seat 23 is mounted on a centrally disposed raised portion 24 on the top of the base portion 25 of the housing 20 and a Belleville washer 26 is seated on the Belleville washer seat 23 with its concave side facing the washer seat 23. However, in contradistinction to the system shown in FIGS. 1 to 3, rather than having a top closure member mounted on Belleville washer 26, a second Belleville washer seat 27 is mounted above Belleville washer 26, its lower portion fitting into the top portion of Be11eville washer seat 23. In like manner, additional Belleville washers and Belleville washer seats are sequentially stacked to provide the repeating, stacked configuration shown in the system illustrated in FIG. 4. A top closure member 28 sealingly engages (i) the inner and uppermost portion of the top Belleville washer 29, (ii) the upper portion of the top Belleville washer seat and (iii) a washer 30 on the screw 31. The screw 31 which, at its lower threaded end, engages an intern ally threaded hole 32 in the base portion 25 of housing 20 acts to secure the structure in the desired configuration as shown in FIG. 4 with the Belleville washers resiliently biased toward their respective Belleville washer seats. As in the system, illustrated in FIGS. 1 to 3, by adjusting the torque on the screw and controlling the physical characteristics of the Belleville washers, the force required to resiliently reform the washers and open the elongated annular orifices between the outer lower edge of each Belleville washer and the respective outer upper surface ofnthe respective Belleville washer seats can be co trolled to provide an orifice of the desired size at a specified operating pressure. In a system comprising a stacked configuration such as that of FIG. 4, the characteristics of each Belleville washer should be substantially the same to provide as uniform a cracking pressure (opening pressure) as possible as well as to provide orifices with substantially uniform operating characteristics, e.g., transverse dimensions, to insure that the fluid being treated encounters similar conditions regardless of which orifice is exited.

In operation, an aggregate-containing fluid under pressure following the path shown by the arrows in FIG. 4 enters the inlet opening 21, flows into the centrally disposed chamber 33 in the base portion of housing 20 and then flows upward through the chamber generally designated 34 surrounding the shaft of screw 31 and then through the four channels, generally designated 35, in each Belleville washer seat to the annular chambers, generally designated 36 in FIG. 4, formed between each Belleville washer seat and its respective Belleville washer. The liquid then exits through the annular orifices formed between the outer, lower edge of the Belleville washers and the outer, upper edge of their respective Belleville washer seats by the pressure of the fluid. The treated fluid then passes out of the housing 20 through the outlet 22. The threaded bleed hole 37 in the top of housing 20 can be used to bleed off gases (air) as required. In normal operation it is closed to prevent the treated fluid from escaping from the top of the housing.

When viewed in the plan view of FIG. 2, the channels generally denoted as 11 in the system illustrated in FIGS. 1–3 are aligned parallel to radii extending from the center line of the system. In the system illustrated in FIGS. 4–5, when viewed in the plan view of FIG. 5, the channels generally denoted as 35 are shown skewed about 30 degrees to radii extending from the vertical center line of the system. Comparable test results have been obtained with both types of channels. Accordingly, aligned channels as shown in FIGS. 1–3 are preferred because of the ease of machining vis-a-vis angled or skewed channels such as those of the system of FIGS. 4–5.

Figure 9:
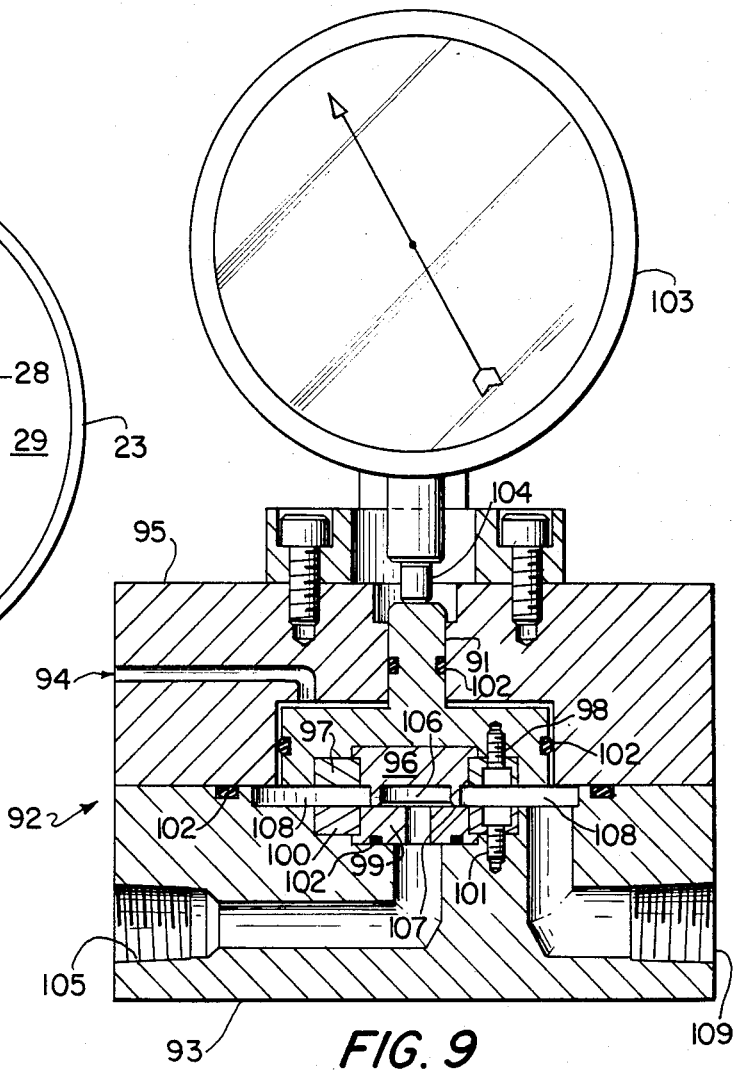
FIG. 9 is an elevation view in cross section of an embodiment of the system of the subject invention wherein a pneumatically-actuated piston resiliently biases a movable, upper dispersion member toward a lower member.

While the systems described above and illustrated in FIGS. 1 to 5 are preferred embodiments, other alternative designs may also be used, such as, for example, systems in which the biasing of one member toward the other is accomplished by hydraulic or pneumatic means. FIG. 9 illustrates in schematic form a system in which a pneumatically driven piston 91 mounted in a housing generally designated 92 is resiliently biased toward the lower portion 93 of the housing 92 by air under pressure entering the space above the piston 91 via a channel 94 tapped through the upper portion 95 of the housing. Mounted on the underside of the piston 91 so that it moves with the piston is an upper dispersion member 96 (shown in more detail in FIG. 9*a*) which is secured to the underside of the piston 91 by a retaining ring 97 which is itself secured to the piston 91 by a screw 98.

Figure 9A:
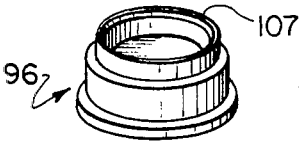
FIG. 9*a* is a perspective of the upper dispersion member of FIG. 9.

A lower dispersio member 99 is mounted on the lower portion 93 of the housing 92 and secured in place by a retaining ring 100 which is itself secured to the lower ortion 93 of the housing by a screw 101. A number of O-rings generally designated 102 are used to seal the system. For some operations it may be desirable to know the transverse dimension of the orifice. In such cases, a displacement indicator, such as that denoted as 103 in FIG. 9, may be used. The indicator in FIG. 9 is mounted so that its lower end 104 is flush with the top of the piston 91 and moves in tandem therewith. Since the upper dispersion member 96 also moves in tandem with the piston 91 while the lower dispersion member 99 re mains fixed, the distance the piston moves, as determined by the displacement indicator 103, is a measure of the transverse dimension of the orifice formed between the upper dispersion member 96 and the lower dispersion member 99 when the system is in operation. FIG. 9*a* is a perspective of the upper dispersion member 96 showing more detail concerning its structure.

In operation, an aggregate-containing fluid under pressure enters the inlet 105 in the lower portion 93 of the hous ng 92 and then flows upward into the central chamber 106 formed between the upper dispersion member 96 and the lower dispersion member 99. Under the pressure of the incoming fluid, the piston is forced upward, forming an elongated annular orifice between the upper surface of the lower dispersion member 99 and the lower, downwardly projecting annular portion 107 of the upper dispersion member 96. As the fluid is forced out through the orifice formed between members 96 and 99 by the pressure of the aggregate-containing fluid, it is subjected to aggregate-dispersing forces, resulting in a more uniformly and finely dispersed medium. After exiting the central chamber 106, it passes into the outer chamber 108 and then out of the housing 92 via outlet 109.

Figure 10:
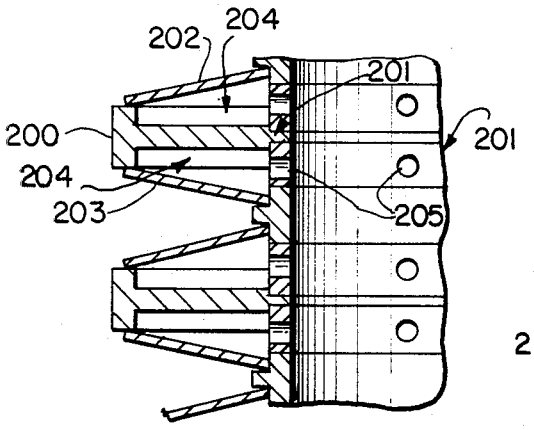
FIGS. 10 and 11 are partial cross sections of alternative designs illustrating two resiliently biased members operatively associated with a single seat member, in FIG. 10 in a stacked, repeating configuration, in FIG. 11 in an unstacked configuration.
Figure 11:
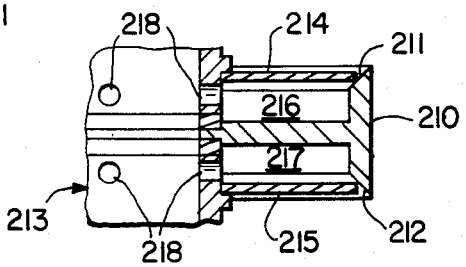

FIGS. 10 and 11 illustrate two alternative designs in broken cross section. In FIG. 10, a relatively rigid member 200 having a generally Tshaped cross section and mounted on a central support member generally designated 201 operates in conjunction with two resiliently biased members 202 and 203 which are themselves supported at their inner edges by central support members 201. The central support member 201 is made up of a series of stacked ring members on which the relatively rigid member 200 and the biased members 202 and 203 are stacked in the alternating manner shown in FIG. 10. Fluid to be treated enters the annular chambers generally designated 204 through the channels generally designated 205. As illustrated in FIG. 10, a stacked configuration can be used to provide increased capacity. Members 202 and 203 can be Belleville washers or other biased, preferab1y resiliently biased, structures.

In FIG. 11 a somewhat analogous system is shown in which a central, relatively rigid member 210 also having a generally T-shaped cross section but with beveled end portions 211 and 212 is mounted on a central support member generally designated 213. Rigid member 210 operates in conjunction with two resilient members 214 and 215. Under the pressure of fluid entering chambers 216 and 217 through the channels 218, resilient members 214 and 215 deform to form orifices at the normal point of contact between members 214 and 215 and the beveled end portions 211 and 212 respectively of rigid member 210. In the embodiment illustrated in FIG. 11, the resilient members 214 and 215 can be, for example, conventional flat washers. Again, a stacked configuration can be used to increase capacity of the system. It should be recognized that, with the configurations illustrated in both FIGS. 10 and 11, the overall central support is preferably formed of individual sections which can be stacked in a repeating manner to facilitate assembly of the system.

Another embodiment contemplated as within the scope of the subject invention is the use of two Belleville washers with their concave sides facing each other and resiliently biased toward each other wherein the fluid introduced into the interior chamber formed by the mating Belleville washers forces the washers apart at their exterior mating surfaces to form a continuous, elongated annular orifice. This type system can also be used in stacked form to provide increased capacity, albeit it is not preferred since, in this type of system, control of the opening of the washers to provide substantially uniform aperture size in the transverse direction and simultaneous opening is difficult to control.

MATERIALS OF CONSTRUCTION

Preferred materials are steel, particularly stainless steel and high carbon steel. Other materials, such as plastics with the requisite properties may also be used. Selection of suitable materials of appropriate resiliency and capable of withstanding the operating conditions encountered is within the purview of those of ordinary skill in the art. Stainless steel is preferred because of its corrosion resistance.

Belleville washers, sometimes also referred to as conical washers, spring discs or conical disc springs, are available commercially. However, for purposes of this invention, where Belleville washers are used as a resiliently biased, deformable component of the system, it may be preferred, where close tolerances are desirable, to treat commercial Belleville washers to render them more suitable for use. This is so because the tolerances and finishes on commercial washers may not be fine enough to provide (1) substantially uniform seating of the outer edge of the washer on the seating member and (2) substantially uniform deforming of the washer under the pressure of the fluid being treated to provide as uniform a transverse dimension or width of the elongated orifice as possible. Accordingly, it may be desirable to lap the Belleville washer where it contacts the washer seat.

Selection of suitable washers can be made by referenCe to the literature and manufacturers' brochures which specify the characteristics. See, for example, the article entitled "Belleville Spring Washers" in the Aug. 5, 1963 issue of *Product Engineering,* McGraw-Hill Publishing Company, Inc. Also see U.S. Pat. No. 3,164,164, the 1982 Spec Handbook of Associated Spring, Barnes Group Inc., for stock precision engineered components, and the article entitled "Conical-Disc Springs" in the Sept. 4, 1958 issue of *Machine Design.* In the latter article, conical-disc springs are defined as initially coned, uniform-section, conical disc springs and Belleville washers more narrowly. As used herein, Belleville spring washer or Belleville washer is used in the broad sense believed commonly accepted today as referring generally to conical disc springs.

The biased member used as a component of the system of this invention must respond under the operating conditions encountered in a manner to provide an elongated orifice having the proper transverse dimension or width. That is, at the operating conditions used for a particular system, the transverse dimension of the orifice must be in the desired range. Accordingly, when a resiliently, biased deformable component is used, such as a Belleville washer, it should be designed for the particular system, bearing in mind (1) tne operating conditions, particularly pressure, that will be encountered, and (2) the desired transverse dimension or width of the elongated orifice witnin the range of from about 1 to about 1,500 micrometers. A Belleville washer or spring disc which has either (1) uniform or (2) regressive deflection characteristics under the operating conditions encountered is preferred. With (1), as the load is increased. the transverse dimension or width of the elongated orifice increases in a linear fashion, i.e., if the pressure or load is doubled, the width of the elongated orifice is doubled. With (2), a doubling of the pressure or load will result in an increase of the width of the elongated orifice which is less than twice that of the initial load. A Belleville washer with progressive deflection characteristics under the operating conditions encountered is undesirable since the danger of the washer snapping open and reversing direction is substantially increased. A reversal of direction of the washer is not acceptable since successful operation of the system of this invention is predicated on maintaining the small transverse dimension or width of the orifice. A reversed washer would (1) allow passage of effectively untreated fluid to pass through the system and (2) require disassembly for repair, both of which are undesirable.

OPERATING CONDITIONS

Systems of this invention can be operated effectively over a pressure range of from about 50 to about 1,000 psid (3.5 to 70.3 kg/cm$^2$), albeit for specific aggregate-containing fluid media more narrow pressure ranges are preferred, as discussed below. By "psid" is meant the pressure difference in pounds per square inch (kg/cm$^2$) between the pressure of the fluid in the system in front of or upstream of the elongated orifice and the pressu e on the downstream side of the elongated orifice, the pressure on the upstream side being higher.

The orifices formed in the operation of systems of this invention are elongated and preferably continuous, most preferably being annular; a practical lower limit for their length being about 3 inches (7.62 cm). That is, the lengths of the orifices are substantially greater than their transverse dimensions or widths, typically 100 or more times greater, ranging up to 20,000 or more times greater or even higher. For example, with the preferred embodiment using a single, type 17-7 PH certified to AMS 5528 stainless steel Belleville washer (catalogue number B2500-120-S in Associated Spring, Barnes Group Inc., 1982 Spec Handbook referred to above) having (1) a nominal outside diameter of 2.5 inches (6.35 cm), (2) a nominal inside diameter of 1.25 inches (31.75 mm), a free-standing height H of about 0.180 inches (4.57 mm) measured from the highest point on the washer when resting uncompressed on a flat surface to the point of contact of the washer with the flat surface, and (3) a stock thickness, t, of about 0.120 inches (3.05 mm), the annular orifice formed in the operation of the system has a length of about 7.9 inches (19.9 cm). At an operating pressure at the lower end of the range specified above, i.e., at about 50 psid (3.5 kg/cm$^2$), the calculated transverse dimension or width of the orifice is about 10 micrometers and the ratio of length to width of the orifice is about 20,000 to 1. With this particular Belleville washer, it is preferred to operate at a pressure not exceeding about 800 psid siice pressures above this point of the load characteristics of the washer are unreliable because of partial bottoming of the washer. At an operating pressure of 800 psid, this washer forms an elongated orifice having a calculated transverse dimension or width of about 1,250 micrometers, providing a ratio of length to width of about 160 to 1.

While, as noted above, a pressure range of from about 50 to about 1,000 psid (3.5 to 70.3 kg/cm$^2$) can be used, a narrower range of operating pressures within the broader range is desirable for specific aggregate-containing fluid media, particularly with the preferred embodiments of the system illustrated in the drawings. In general, operating pressures of at least about 100 psid (70.3 kg/cm$^2$) are preferred since the treated fluids in general demonstrate improved characteristics when treated at pressures of about 100 psid (70.3 kg/cm$^2$) or higher. For some operations it has been found that even higher pressures are desirable. For example, in the dispersion of carbon black, it is preferred to operate at a minimum operating pressure of about 400 psid (28.1 kg/cm$^2$) and with a preferred range of from about 400 to 600 psid (28.1 to 42.2 kg/cm$^2$).

Well completion fluids containing a viscosifying agent, such as HEC or the like, typically contain from about 0.2 to about 0.25 weight percent of the viscosifying agent when injected into the well. These fluids can be treated effectively using the system of this invention either at the injection concentration or at higher concentrations, e.g., from about 0.2 to about 1.0 weight percent, following which they can be diluted to the desired concentration prior to injection into the well. In a preferred embodiment, the well completion fluid is treated using the system of this invention, following which the treated fluid is diluted—if a concentrated form of the fluid was treated—and then filtered prior to injection into the well. In a preferred combined treating process, the concentrated form of the well completion fluid containing up to about 1 percent of the viscosifying agent, such as HEC or the like, is passed through the system of this invention, following which it is filtered through a depth rilter, e.g., a microfibrous polypropylene filter in the form of a corrugated filter element having, for example, an absolute pore rating of about 10 micrometers. The resulting treated and filtered well completion fluid is then injected into the well.

As noted above, when a concentrated fluid is treated, it is preferred to dilute the fluid to the concentration at which it will be injected prior to filtration to improve filtering characteristics, since the concentrated form of the well completion fluid is typically quite viscous. In the treatment of well completion fluds containing a viscosifying the like dispersion of gels agent, such as HEC or the like, dispersion of gels therein without substaitial adverse effects on viscosity is required, i.e., a greater than about 10 percent reduction in the normalized viscosity based on the viscosity measured on the viscometer and at the conditions specified under "Method Of Testing Viscosity" below. For this reason, a preferred operating pressure range for treatment of well completion fluids containing a viscosifying agent, such as HEC or the like, is from about 50 to about 575 psid (3.5 to 40.4 kg/cm$^2$) and, more preferably, from about 200 to about 575 psid (14.1 to 40.4 kg/cm$^2$). At pressures above about 575 psid (40.4 kg/cm$^2$), the viscosity of the fluid, particularly at a concentration of about 0.25 weight percent HEC, begins to tail off undesirably.

When treating well completiion fluids containing a viscosifying agent, preferred treatment flow rates are in the range of from about 20 to about 100 gallons per minute (75.7 to 378.5 liters per minute), more preferably from about 20 to about 30 gallons per minute (75.7 to 113.5 liters per minute). Flow rates in this range, particularly at the upper end, favor the use of a stacked configuration such as that shown in FIG. 4, to provide the desired throughput at the desired operating pressure.

For the treatment of metal oxide containing fluids such as those used in the manufacture of magnetic tapes, a minimum pressure of about 300 psid (21.1 kg/cm$^2$) is preferred. Since these fluids have relatively high viscosties, higher operating pressures are preferred, typically from about 600 to 800 psid (42.2 to 56.2 kg/cm$^2$). Preferred flow rates for such fluids range from about 0.5 to about 2 gallons per minute (1.9 to 7.6 liters per minute).

In general, the lowest operating pressure that will affect the desired treatment is preferred since (1) the economics are more favorable and (2) there is less potential for damage to the fluid media, e.g., undesirable breakup of individual particles such as the high aspect ratio needle-like metal oxide particles used in magnetic tape manufacture.

This invention will be better understood by reference to the following examples which are offered by way of illustration In the following examples, as well as throughout the specification, all parts and percentages are by weight unless otherwise noted.

METHODS OF PREPARATION OF COMPOSITIONS AND TEST METHODS USED IN THE FOLLOWING EXAMPLES

1. Preparation of Water-based Hydroxyethylcellulose Compositions

Water-based hydroxyethlycellulose (HEC) compositions were prepared by adding the requisite amount of HEC powder to water (by sprinkling the powder into the water) while mixing with a propeller-type mixer. The mixing was carrieo out at a moderate rate for a minimum of about three and one-half hours (or as otherwise noted) prior to testing of the composition. Two types of HEC were used: (a) Union Carbide Corporation's Cellosize QP100M, a rapidly dispersing grade having a bulk viscosity of 4,000 to 5,200 centipoise as a one percent aqueous solution at 25 degrees C. when tested on a LVF Brookfield viscometer with a number 4 spindle at 30 RPM and (b) Hercules Inc.'s Natrosol 250HHW, a fast dispersing grade having a bulk viscosity of 3,400 to 5,7000 centipoise as a one percent aqueous solution at 25 degrees C. when tested with the same viscometer with the same spindle and at the same RPM as in (a) above.

2. Method of Testing Viscosity:

Viscosity measurements on the systems discussed below were carried out by using one and one-half milliliter samples of the compositions in a Brookfield Model LVT cone and plate viscometer with a spindle number CP42 operating at 12 RPM and with the sample held at 25 degrees Centigrade.

3. Method for Determining Filterability

Approximately 200 milliliters of the fluid medium to be tested was poured into a 250 milliliter sidearm filtration flask. The flask was then closed with a rubber stopper and a 6 inch (15.2 cm) length of quarter inch (6.4 mm) stainless steel tubing passed through the stopper into the solution terminating approximately one-half inch (1.27 cm) above the bottom of the flask. A length of clear, quarter inch (6.4 mm) flexible plastic tubing was used to connect the stainless steel tubing to an opening in the top of the housing of a filter jig containing four 47 millimeter diameter filter discs. These were in order from upstream to downstream side: (1) a relatively coarse, nonwoven polypropylene prefilter, (2) a fibrous polypropylene filter disc having an absolute pore rating of 70 micrometers and a basic weight of 8 grams per square foot (929 square centimeters), (3) a fibrous polypropylene filter disc having an absolute pore rating of 10 micrometers and a basis weight of 2.5 grams per square foot (929 square centimeters) and (4) a 1.2 micrometer absolute pore rating nylon filter membrane.

The filter discs described above were pre-wetted with 3 milliliters of ethanol and the jig housing bolted in place above the filtration flask. The connecting line (stainless steel tubing and plastic tubing) and the upper portion of the jig housing were then slowly filled with the fluid medium in the flask by applying a slight air pressure to the sidearm of the filtration flask. When fluid began to flow from the bleed hole in the top portion of the housing of the filter jig, the hole was closed. At this point the line connecting the filtration flask and the filter jig housing along the portion of the jig housing ahead of the first filter disc were filled with the fluid medium to be filtered and were free of air.

The sidearm of the filtration flask was then connected to a regulated air supply with quarter inch (6.4 mm) plastic tubing and an air pressure of 5 psi (0.35 kg $cm^2$) applied at the same time that a stop watch was started. Filtrate from the filter jig was collected and measured is a function of time. The volume of fluid collected in a graduated cylinder was recorded to the nearest 0.1 milliliter at one minute intervals up to ten minutes from the initiation of the application of the 5 psi (0.35 $kg/cm^2$) pressure. At the end of ten minutes the total volume of filtrate collected was recorded and the air pressure disconnected. "Filterability" as used herein is defined as the total volume of fluid medium (including ethanol) in millilters which has passed through the filter and been collected in ten minutes.

In the following examples the washer used in all the tests with the exception of 5(*b*) was that previously described, namely, the washer designated B-2500-120-S in the Spec Handbook discussed above. For the test of sample 5(*b*), the Belleville washer used was stainless steel formed from the same grade of steel, but designated B-2500-080-S and having the same nominal physical dimensions as B-2500-120-S in an uncompressed state except that the stock thickness, t, was 0.080 inches (2.03 mm) and the height, H, was 0.160 inches (4.06 mm). Accordingly, the spring constant was lower than with the B-2500-120-S washer.

Example 1:

To illustrate the ability of the system of this invention to disperse needle-like or elongated particles having relatively high aspect ratios without destruction of the individual particles, i.e., breakup of the particles and destruction of their high aspect ratio, the following procedure was carried out using the apparatus illustrated in FIGS. 1–3.

To 3,480 grams of a 1% Triton X-100 (a surfactant which is an adduct of ethylene oxide and nonyl phenol in a molar ratio of about 10 to 1, available from Rohm and Haas Company) in water solution was added 303 grams of chromium dioxide particles having a particle length of from about 0.6 to about 0.8 micrometers and an aspect ratio of from about 10–15:1, i.e., the length of the particles were from 10 to 15 times their diameter, to form a suspension containing 8 percent chromium dioxide. Chromium dioxide in this form is available from E. I. DuPont de Nemours and Company under the designation A-500-01 and is used in the manufacture of high fidelity magnetic tapes.

The resulting suspension was gently stirred by hand and a sample of the suspension was then removed and further diluted with a 0.1 percent Triton X-100 in water solution to reduce the chromium oxide concentration to a level of about $8\times10^{-4}$ percent. Five milliliters of this $8\times10^{-4}$ chromium oxide concentration suspension was then filtered through a 0.2 micrometer polycarbonate membrane (available from Nuclepore Corporation). The retained chromium dioxide on the membrane was then photographed at a magnification of 5,000 using a scanning electron microscope. The results are shown in FIG. 6.

Figure 7:
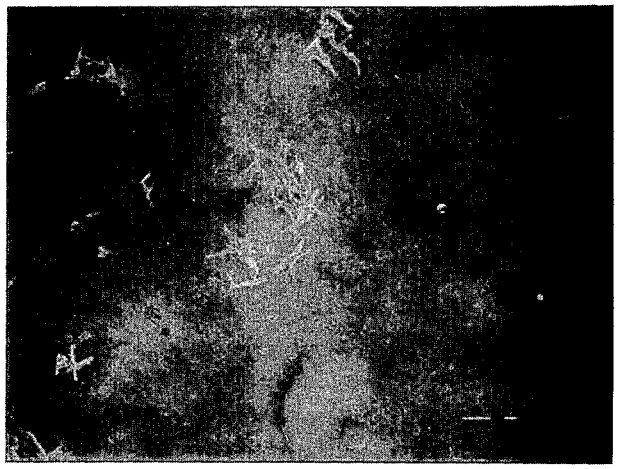
FIG. 7 is a photomicrograph at five thousand times magnification showing the level of dispersion of chromium dioxide needle-like particles in water after one pass through the system of FIGS. 1–3.

A portion of the 8 percent by weight chromium dioxide suspension described above was passed through the system illustrated in FIGS. 1–3 at a pressure of 350 psid (24.6 kilograms per square centimeter) at an approximate flow rate of 3 gallons per minute (11.4 liters per minute). Samples were collected (1) after one pass and (2) after three passes through the system. The samples collected were then independently diluted as indicated above to provide suspensions having a chromium dioxide concentration level of about $8\times10^{-4}$ percent. The dilute suspensions were then each independently filtered through a 0.2 micrometer Nuclepore membrane. Scanning electron microscope photographs were taken of the retained chromium dioxide on the membrane at a magnification of 5,000. The result after one pass through the system is illustrated in FIG. 7. The result after three passes through the system is illustrated in FIG. 8.

Figure 6:
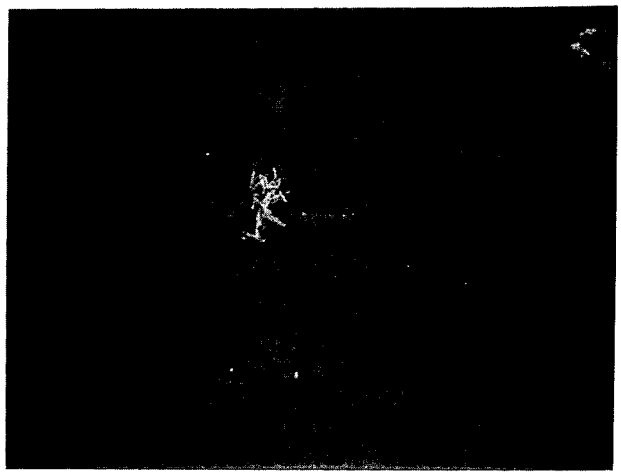
FIG. 6 is a photomicrograph at five thousand times magnification showing aggregates or clustered masses of chromium dioxide needle-like particles which have been hand mixed in water.
Figure 8:
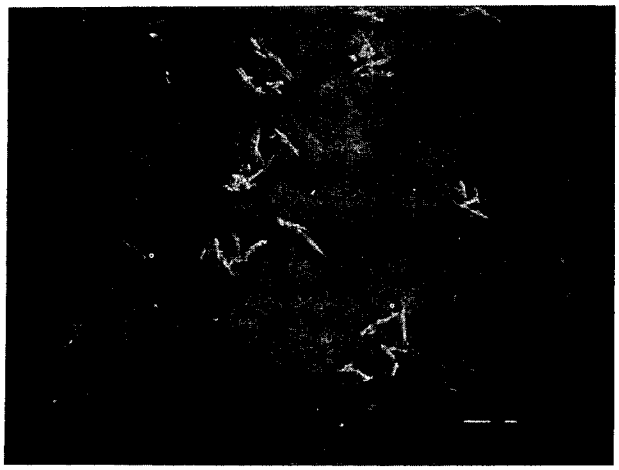
FIG. 8 is a photomicrograph at five thousand times magnification showing the level of dispersion of chromium dioxide needle-like particles in water after three passes through the system of FIGS. 1–3.

From a consideration of FIGS. 6 to 8, the substantially enhanced dispersion characteristics after one pass of the chromium dioxide suspension through the system of this invention is clear. The aggregates are, in large part, substantially smaller and looser than with the hand mixed material even after one pass. Referring to FIG. 8, after three passes, the dispersion of the aggregates was further enhanced as evidenced by the relative absence of large clusters of chromium dioxide particles compared to the hand mixed control illustrated in FIG. 6. Additionally, the individual chromium dioxide particles maintain their high aspect ratio, i.e., there is substantially no apparent breakup of the individual chromium dioxide particles, even after three passes through the system.

This example demonstrates the ability of the system and method of this invention to provide a high level of dispersion of aggregates of needle-like particles without substantial break-down of the particles themselves, a highly desirable, indeed necessary, characteristic or a system which is used to disperse high aspect ratio metal oxide particles which are to be used in the manufacture of high fidelity magnetic tape.

EXAMPLE 2

The system illustrated in FIGS. 1–3 was also used to disperse carbon black by the method described below to demonstrate the ability to obtain high levels of dispersion of aggregates of pigment-like materials. The following procedure was used.

6.5 grams of Triton X-100 were added to 6.5 liters of water with mixing provided by a propeller type stirrer. After dissolution of the Triton X-100, 0.065 grams of carbon black having an average particle size of about 13 nanometers and a BET of about 460 $m^2/gm$ (available from the West German Company, Degussa, under their designation FW200) was added to the Triton X-100 solution and mixed for a minimum of fifteen minutes using the same propeller-type stirrer. The dispersion of approximately 0.001 percent carbon black was subjected to a colorimeter test using a Klett Summerson colorimeter (Model 900-3). After a ten-fold dilution of a portion of the dispersion, i.e., 10 milliliters of the dispersion of carbon black, was diluted to a volume of 100 milliliters by addition of 90 milliliters of a 0.1 percent Triton X-100 solution in water, the dispersion of carbon black (at approximately 0.0001 percent carbon black) was again subjected to a colorimeter test using the Klett Summerson colorimeter (Model 900-3).

The balance of the undiluted dispersion was then passed through the system illustrated in FIGS. 1–3 at a flow rate of 3 gallons per minute (11.4 liters per minute) and a pressure of 300 psid (21.1 kilograms per square centimeter) and a colorimeter test run on the resulting dispersion. A sample of this dispersion (after it had been passed through the system once) was diluted ten-fold as above and a colorimeter reading again obtained.

In like manner, the balance of the undiluted dispersion was then passed through the system a second time at the same flow rate and pressure, a colorimeter test run on the resulting dispersion and a sample of the dispersion (after it had been passed through the system twice) was then taken which was again diluted ten-fold as above and a colorimeter reading again obtained. Finally, the balance of the dispersion (after removal of the samples as noted above) was passed through the system a third time at the same pressure and flow rate. A colorimeter test was run on the resulting dispersion. A sample of the dispersion (after it had been passed through the system three times) was then taken, again diluted ten-fold as above and a colorimeter reading again obtained. The results are shown in Table I below.

TABLE I

| Number of Passes Through System | Weight Percent Carbon Black In Dispersion | Colorimeter Reading |
|---|---|---|
| 0 | .001 | 33 |
| | .0001 | 6 |
| 1 | .001 | 397 |
| | .0001 | 39.5 |
| 2 | .001 | 715 |
| | .0001 | 71 |
| 3 | .001 | 720 |
| | .0001 | 72.5 |

For the results set out above, the higher the colorimeter reading, the better the dispersion. As can be seen from Table I, substantially enhanced dispersion levels are achieved after two passes with very limited additional improvement after a third pass through the system.

EXAMPLE 3

18.9 grams of Triton X-100 were added to 18.9 liters of water with mixing provided by a propellertype stirrer. After dissolution of the Triton X-100, 0.189 grams of carbon black (FW200 from Degussa Corporation) was added to the Triton X-100 solution and mixed with the propeller type stirrer for a minimum of 30 minutes.

Figure 12:
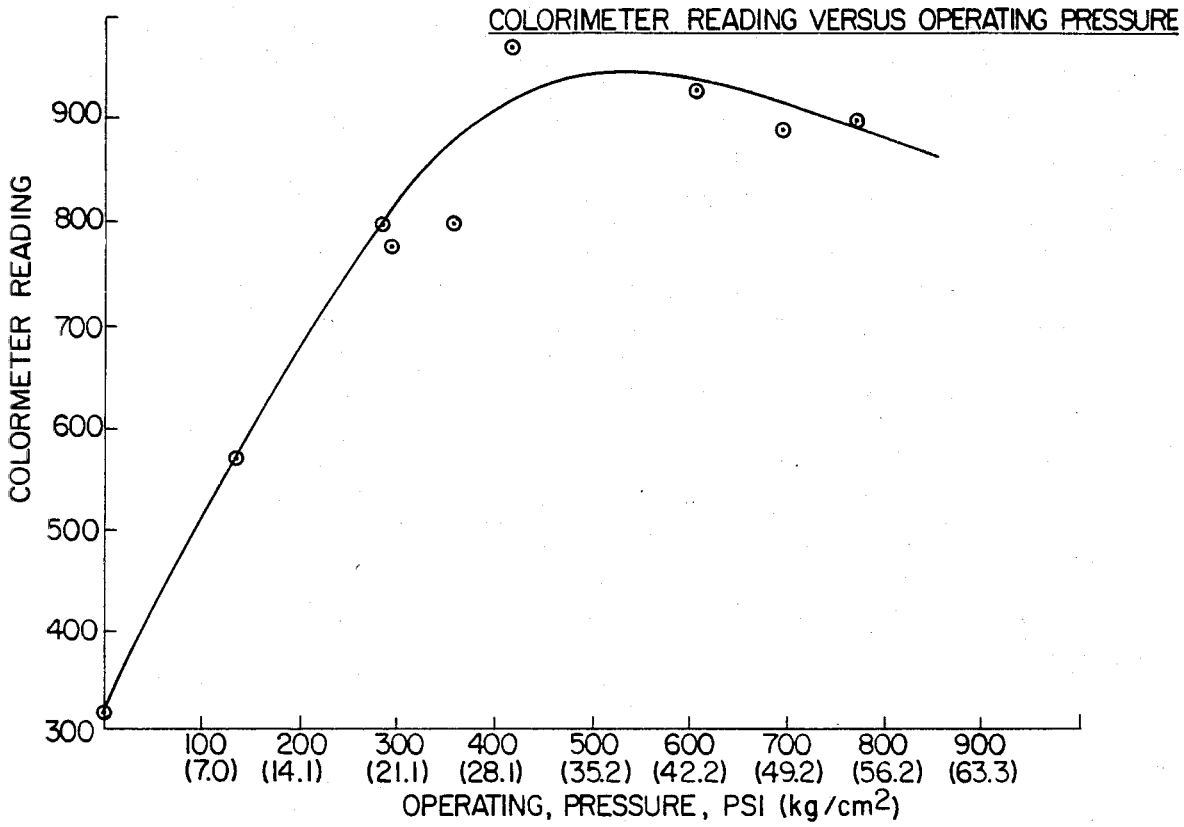
FIG. 12 is a graph of colorimeter reading versus operating pressure for a carbon black dispersion treated with the system of FIGS. 1—3.

The resulting water based composition (dispersion) was treated by passing it through the system illustrated in FIGS. 1–3 (but by using the closure member, the Belleville washer, and the Belleville washer seat with angled or skewed channels from the system illustrated in FIGS. 4–5 in the basic system illustrated in FIGS. 1–3) at a flow rate of about 3 gallons per minute (11.4 liters/minute) using a piston type, positive displacement pump (Model 280 "Cat" available from Cat Pumps Corporation) at the various operating pressures, as specified in Table II below. Note: the range of pressures were obtained at a constant flow rate by varying the torque on the screw 6 used to resiliently bias the Belleville washer 3 toward the Belleville washer seat 2. Colorimeter readings were made on the treated compositions using the same Klett Summerson colorimeter as in Example 2 above. The results are shown in Table II below and are also shown plotted in FIG. 12. The results indicate that the preferred minimum operating pressure for dispersion of carbon black was above about 400 psid (28.1 kg/cm$^2$) with a preferred range being from about 400 to about 600 psid (28.1 to 42.2 kg/cm$^2$). As evident from FIG. 12, the colorimeter reading began to tail off at pressures above 600. While not wishing to be bound by this theory, it is theorized that the level of dispersion of the carbon black at these higher pressures may have been so high as to result in the particle size of a portion of the carbon black falling below the wavelength of visible light, resulting in a reduced colorimeter reading.

TABLE II

| Sample | Fluid Pressure psid (kg/cm$^2$) | Colorimeter Reading |
|---|---|---|
| a (Control) | | 318 |
| b | 280 (19.7) | 800 |
| c | 410 (28.8) | 975 |
| d | 600 (42.2) | 930 |
| e | 765 (53.8) | 900 |
| f | 135 (94.9) | 570 |
| g | 290 (20.4) | 780 |
| h | 352 (24.8) | 800 |
| i | 690 (48.5) | 890 |

EXAMPLE 4

A stock composition containing 0.25% HEC (Cellosize QP100M) was prepared by the method described above. A portion of this stock composition was tested for its viscosity and filterability by the methods also described above.

Dilute compositions of HEC in water were then prepared by diluting the stock composition with water to form compositions containing (1) 0.125% HEC and (2) 0.0625% HEC. The viscosity and filterability of these diluted compositions were similarly determined. The results are shown in Table III below:

TABLE III

| Sample | Concentration HEC (wt. %) | Filterability (ml) | Improvement in % over 0.25% HEC Control | Viscosity (centipoise) | Normalized Viscosity[1] |
|---|---|---|---|---|---|
| 4a | 0.25 | 30.2 | — | 27.0 | 1.000 |
| 4b | 0.125 | 54.6 | 81 | 8.3 | 0.307 |
| 4c | 0.0625 | 91.7 | 204 | 2.75 | 0.102 |

[1]Normalized viscosities are obtained by dividing the viscosity of the treated fluid media by that of the base fluid media (in this case the untreated 0.25% HEC composition)

This example shows that with untreated water based HEC compositions prepared by a simple mixing procedure it it necessary to dilute a 0.25% HEC composition to one-fourth its initial concentration to increase its filterability by a factor of about 3, i.e., from 30.2 ml to 91.7 ml. The viscosity versus filterability for the untreated samples 4*a*–4*c* of Table III are shown plotted in FIG. 13.

EXAMPLE 5

Figure 15:
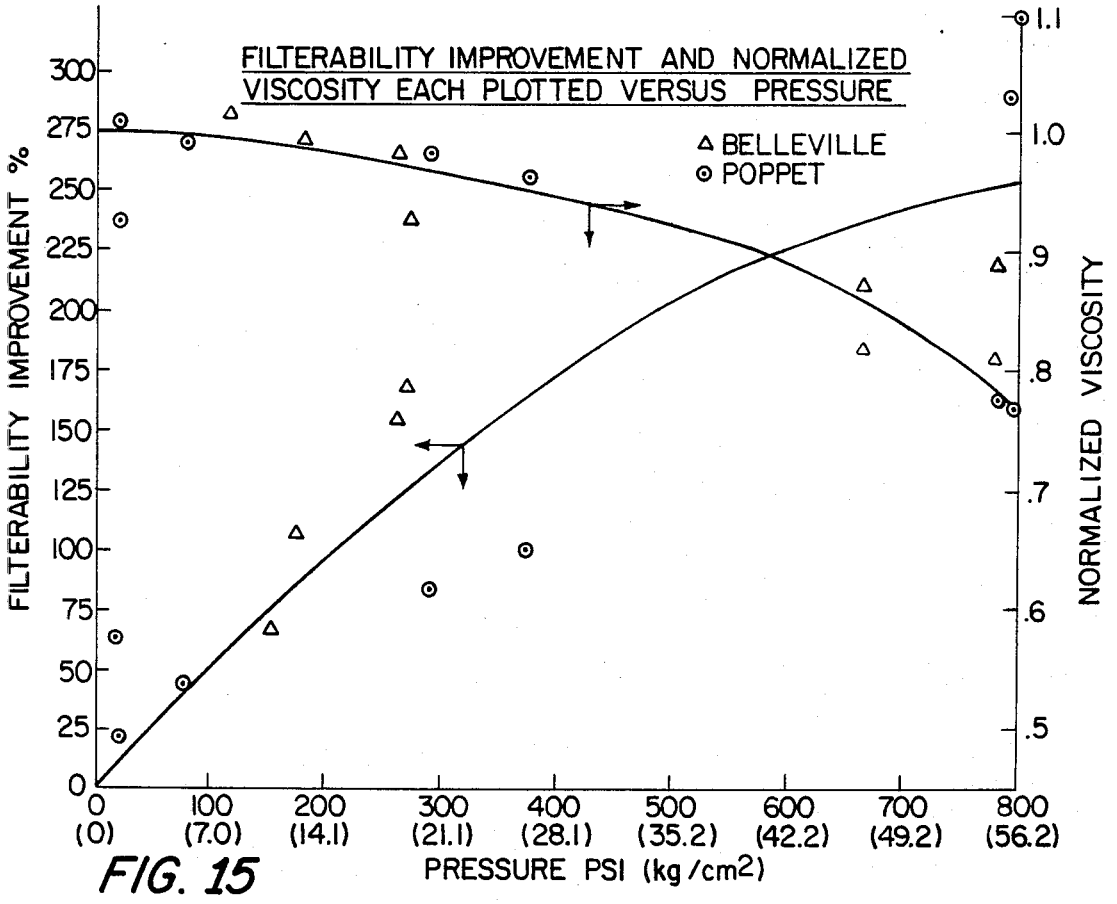
FIG. 15 is a graph of (1) filterability versus fluid pressure and (2) normalized viscosity versus fluid pressure.

A water based fluid medium containing 0.25% HEC (Cellosize QP100M grade HEC) was treated by passing it through the same system as in Example 3 under the conditions described in Table IV below. The filterability and normalized viscosity, each plotted versus pressure, are shown in FIG. 15.

Figure 13:
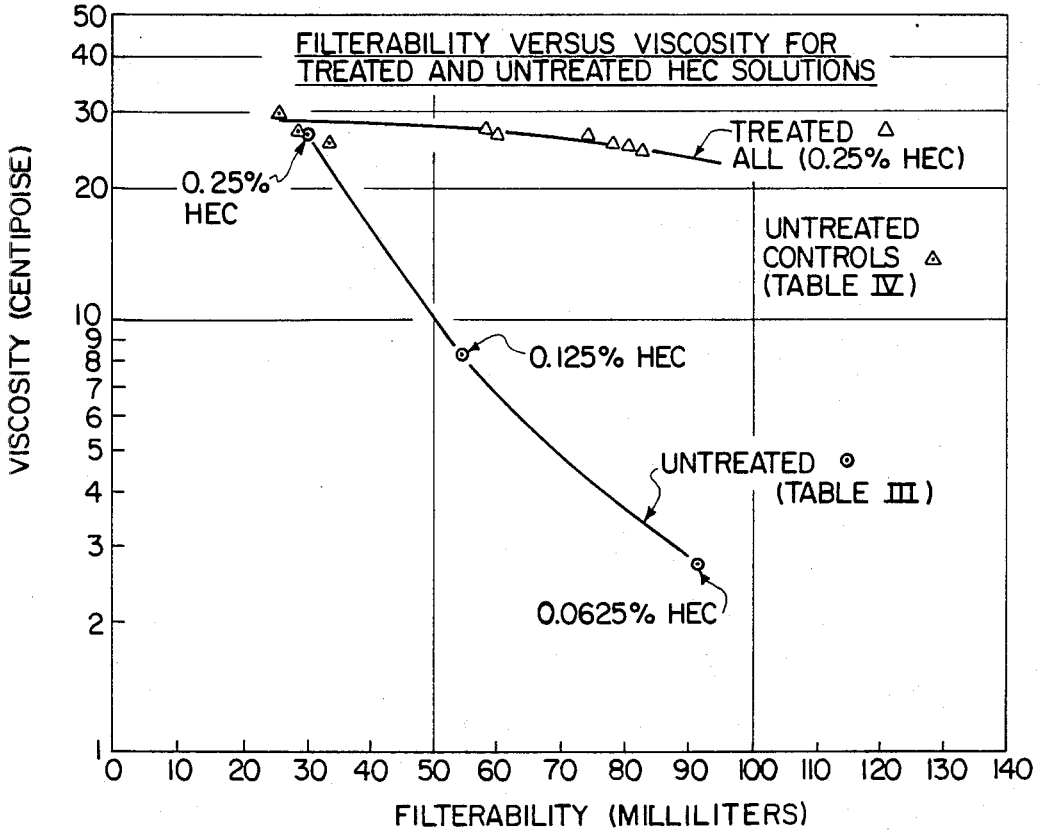
FIG. 13 is a graph of viscosity versus filterability for treated and untreated HEC solutions.

The viscosity versus filterability for the samples of Table IV below are shown plotted in FIG. 13. A comparison of the curves for the samples of Example 5 (Table IV) versus the untreated samples of Example 4 (Table III) illustrate the dramatic improvement in filterability that can be obtained by the method of this invention. The results illustrated in FIG. 13 indicate the following:

(1) filterabilities comparable to those obtained using HEC compositions treated by the method of this invention can only be obtained in untreated compositions by substantial reductions in HEC concentrations and concomitant undesirable reduction in viscosity, and (2) treatment of HEC compositions by the method of this invention enhances filterability without adversely affecting viscosity in a substantial manner, i.e., by about 10 percent or greater.

TABLE IV

| Sample | Flow Rate (l/min) | Fluid Pressure psid (kg/cm²) | Filterability (ml) | Improvement % | Viscosity (centipoise) | Normalized Viscosity |
|---|---|---|---|---|---|---|
| 5a | Control | — | 29.2 | — | 27.3 | 1.000 |
| 5b | 2.2 | 178 (12.5) | 61.4 | 110 | 27.1 | 0.993 |
| 5c | 12.7 | 260 (18.3) | 74.4 | 155 | 26.75 | 0.980 |
| 5d | 24.7 | 270 (19.0) | 78.3 | 168 | 25.5 | 0.934 |
| 5e | Control | — | 34.9 | — | 27.1 | 1.000 |
| 5f | 2.5 | 152 (10.7) | 58.6 | 68 | 27.5 | 1.014 |
| 5g | Control | — | 25.8 | — | 30.0 | 1.000 |
| 5h | 10.7 | 665 (46.8) | 80.6 | 212 | 25.0 | 0.833 |
| 5i | 11.85 | 780 (54.8) | 82.6 | 220 | 24.3 | 0.810 |

EXAMPLE 6

Figure 14:
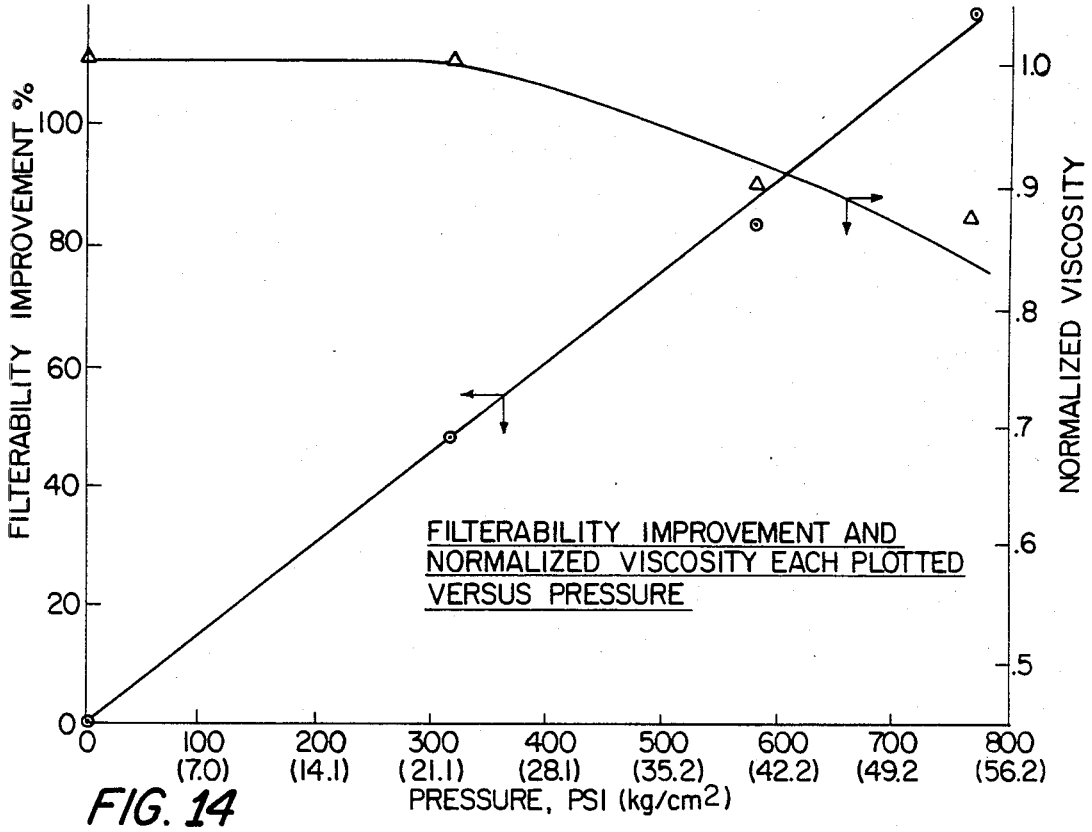
FIG. 14 is a graph of (1) filterability versus fluid pressure and (2) normalized viscosity versus fluid pressure.

Water based compositions containing 0.25% HEC (Natrosol 250 HHW) prepared by the method described above were passed through the same system used in Example 3 above under the conditions noted in Table V below. The fluid was collected after one pass through the system and viscosity and filterability measurements made by the methods described above. The results are shown in Table V and are shown plotted in FIG. 14.

TABLE V

| Sample | Flow Rate (l/min) | Fluid Pressure psid (kg/cm²) | Filterability (ml) | Improvement % | Viscosity (centipoise) | Normalized Viscosity |
|---|---|---|---|---|---|---|
| 6a | Control | — | 39.5 | — | 26.0 | 1.000 |
| 6b | 11.2 | 315 (22.2) | 58.3 | 48 | 26.2 | 1.008 |
| 6c | 11.2 | 583 (41.0) | 72.0 | 84 | 23.5 | 0.903 |
| 6d | 11.6 | 765 (53.8) | 85.8 | 119 | 22.8 | 0.877 |

EXAMPLE 7

A 1% by weight HEC in water composition (Cellosize QP100M) was prepared by adding 3.78 kg of HEC to 374.8 kg of $H_2O$ while mixing with a propeller type mixer by the method described above. The solution was allowed to mix overnight and was then tested using the system illustrated in FIG. 4–5. A portion of the 1% by weight HEC in water composition was passed through the device at the pressure and at the flow rate indicated in Table VI. A sample of the fluid collected downstream of the system and a control sample of the composition prior to passage through the system were each individually diluted to 0.25% HEC and filterability and viscosity tests were run on the diluted 0.25% HEC compositions. The results are summerized in Table VI.

TABLE VI

| Sample | Flow Rate (gal/min) | Fluid Pressure psid (kg/cm²) | Filterability (ml) | Improvement % | Viscosity (centipoise) | Normalized Viscosity |
|---|---|---|---|---|---|---|
| 7a | 16 | 275 (19.3) | 46.8 | 80 | 27.3 | .97 |

TABLE VI-continued

| Sample | Flow Rate (gal/min) | Fluid Pressure psid (kg/cm²) | Filterability (ml) | Improvement % | Viscosity (centipoise) | Normalized Viscosity |
|---|---|---|---|---|---|---|
| 7b | Control | — | 26.0 | — | 28.15 | 1.0 |

This example demonstrates that the system illustrated in FIGS. 4 and 5 substantially enhanced the filterability of a 1% HEC composition (by 80%) while having only a minor effect on the viscosity of the diluted composition, 27.3 centipoise versus 28.15 centipoise.

EXAMPLE 8

A water based fluid medium containing 0.25% HEC (Cellosize QP100M) was treated by passing it through a system of the type illustrated in FIGS. 9 and **9*a* under the conditions specified in Table VII below. In the test system used in this example, the channel through which air enters the space over the piston was tapped through the back side of the upper portion of the housing rather than through the side, as illustrated in FIGS. 9 and 9*a*. The results are shown plotted in FIG. 15**.

TABLE VII

| Sample | Flow Rate (l/min) | Fluid Pressure psid (kg/cm²) | Filterability (ml) | Improvement % | Viscosity (centipoise) | Normalized Viscosity |
|---|---|---|---|---|---|---|
| 8a | 9.16 | 375 (26.4) | 69.8 | 100 | 26.1 | 0.963 |
| 8b | 0.08 | 21 (1.5) | 35.8 | 21 | 28.0 | 1.009 |
| 8c | 0.87 | 20 (1.4) | 48.2 | 63 | 25.65 | 0.924 |
| 8d | 0.38 | 800 (56.2) | 123.4 | 318 | 21.4 | 0.771 |
| 8e | 2.83 | 790 (55.5) | 115.0 | 290 | 21.5 | 0.775 |
| 8f | Control | — | 29.5 | — | 27.75 | 1.000 |
| 8g | Control | — | 34.9 | — | 27.1 | 1.000 |
| 8h | 8.90 | 290 (20.4) | 63.4 | 82 | 26.6 | 0.982 |
| 8i | 9.84 | 78 (5.50) | 50.2 | 44 | 26.9 | 0.993 |

EXAMPLE 9

Samples of treated (by passing the composition through the same system used in Example 3 above) and untreated 0.25% HEC (Cellosize QP100M) in water compositions were tested for their filterability through different size filter media using the Method for Determining Filterability described above. The treated samples were passed through the system described in Example 3 at a pressure of 560 psi (39.4 kg/cm²) at a flow rate of 4.8 gpm (18 l/min). With the first sample (as indicated in Table VIII below), the final filter disc had an absolute pore rating of 1.2 micrometers. With samples 9b and 9c, the final filter disc had absolute pore ratings of 0.8 and 0.65 micrometers respectively. The results are shown in Table VIII below.

TABLE VIII

| Sample | Pore Size (μm) | Filterability Treated (ml) | Filterability Untreated (ml) | Improvement % |
|---|---|---|---|---|
| 9a | 1.2 | 106.3 | 32.1 | 231 |
| 9b | 0.8 | 50.0 | 11.5 | 335 |
| 9c | 0.65 | 43.1 | 8.9 | 384 |

Filterabilities obtained in the various experiments using 0.25% HEC are expressed as filterability percent improvements and are plotted against pressure in FIG. 15. The data are also shown plotted as normalized viscosity versus pressure in FIG. 15. Normalized viscosity is obtained by dividing the viscosity of the treated solution by that of its untreated control. The curves of FIG. 15 when superimposed define an optimum operating region for treating HEC defined by an upper pressure of about 575 psid (40.4 kg/cm$^2$) and a normalized viscosity of about 0.9 and a lower pressure of about 50 psid (3.5 kg/cm$^2$) with a filterability improvement of about 25 percent, more preferably from about 200 to about 575 psid (14.1 to 40.4 kg/cm$^2$).

Above the optimum pressure, gains in filterability are achieved only with an accompanying, substantial (greater than about 10 percent) and undesirable reduction in normalized viscosity. Below the optimum, minimum operating pressure, normalized viscosity is not reduced significantly but neither is filterability increased as substantially. Note that in the optimum operating region defined above, a small change in the normalized viscosity (about 10 percent or less) results in a significant filterability improvement of at least about 25 percent. In the more narrowly defined preferred range of from about 200 to about 575 psid (14.1 to 40.4 kg/cm$^2$), the filterability improvement ranges from about 95 percent to about 225 percent. This is remarkable, considering that in an untreated HEC solution similar increases in filterability can only be obtained by lowering the HEC concentration by fourfold from 0.25 percent HEC to 0.0625 percent, as shown in FIG. 13.

It is believed that the above remarkable effect on filterability is due to a shift in the gel particle size distribution toward a smaller and better dispersed gel fraction. This shift is accompanied by only a minimal change in bulk viscosity. This shift in gel size distribution is illustrated by the results shown in Example 9. By subjecting the treated and untreated solutions to filtration through progressively smaller membranes of known pore size and measuring the amount of effluent collected in a given time through each membrane of different pore size, it is evident that as the membrane pore size decreased from 1.2 mircrometers to 0.65 micrometers, the amount of effluent collected for a sample that was treated with the system used in Example 3 is greater than the amount collected for an untreated sample. The results tabulated in Table VIII demonstrate this.

EXAMPLE 10

Extended Operation Abrasion Testing 36.0 grams of AC Fine Test Dust (AC Spark Plug Division, General Motors Corporation) having the specifications set out in Table IX below were wetted with 200 milliliters of water, stirred and added to 6 liters of a 0.25% HEC solution (Cellosize QP100M) prepared by the method described above. The resulting composition was then mixed for about 10 minutes with a Cowles mixer. This mixture was then added to 67.4 liters of a similarly prepared 0.25% HEC (Cellosize QP100M) solution and stirred with a propeller type mixer. The resulting composition had a concentration of about 490 ppm AC Fine Test Dust. This solution was circulated through the system illustrated in FIGS. 1 to 3 for about 6 hours at a rate of 3 gpm (11.4 l/min) and a differential pressure of 330 psid (23.2 kg/cm$^2$). At the end of 6 hours onstream, the system was drained and the test composition replaced by an identical charge of about 490 ppm AC Fine Test Dust in 0.25% HEC solution. This new solution was circulated for an additional 6 hours at the same rate and pressure. Both test systems were operated submerged in the circulating fluid composition. At the end of 12 hours total time onstream, the system was disassembled and examined. No buildup of dirt particles was observed in the annular chamber 12 or in the vicinity of the orifice formed between the Belleville washer and the Belleville washer seat.

A fresh charge of 0.25% HEC solution (uncontaminated with test dust) was then passed through the system at 3 gpm (11.4 l/min) and 290 psid (20.4 kg/ cm$^2$). Filterability and viscosity tests were performed on the processed uncontaminated sample and on an unprocessed control of the same uncontaminated 0.25% HEC composition according to the procedures described above. After 12 hours of operation with an abrasive dust containing composition, the system improved the filterability of a 0.25% HEC composition by 94% with a reduction in viscosity of about 10%, results comparable to those obtained with this system prior to the extended abrasion test. No substantial degradation or wearing of the system was observed upon examination of the device after 12 hours of operation in the abrasive environment. Some minimal scoring of the washer seat and the Belleville washer at their outer edges was observed but no significant wear was observed and the operability of the system was unaffected.

TABLE IX

| AC FINE AIR CLEANER TEST DUST SPECIFICATIONS | |
|---|---|
| 0–5 micrometers | 39 ± 2% |
| 5–10 micrometers | 18 ± 3% |
| 10–20 micrometers | 16 ± 3% |
| 20–40 micrometers | 18 ± 3% |
| 40–80 micrometers | 9 ± 3% |

INDUSTRIAL APPLICABILITY

The system and method of this invention find use in a variety of industrial applications. These include (1) in the treatment of oil and gas well treatment fluids, such as viscosified brines containing hydroxyethylcellulose, to reduce the size of gel aggregates and reduce filter plugging, (2) in the preparation of dispersions of mixtures of metal oxides and resins used in the manufacture of magnetic tape and in dispersing aggregates formed in such dispersions, rendering them less prone to filter plugging, (3) in the dispersion of pigments such as carbon black used in the formulation of paints, and (4) in the treatment of polymer spinning and casting compositions prior to their use in fiber spinning and film fabrication.

We claim:

1. A self-cleaning system for dispersing aggregrates in a fluid medium comprising first and second members operatively associated to form an internal chamber and having an inlet to said chamber for admitting said fluid, and with at least one of said members resiliently biased toward the other, whereby the introduction of said fluid medium into said chamber under a pressure in the range of from about 50 to about 1,000 psid deforms said at least one of said members to provide an elongated orifice between said first and second members for egress of said fluid medium, said elongated orifice under said pressure having a minimum length of about 3 inches, a transverse dimension or width in the range of from about 1 to about 1,500 micrometers and a ratio of its length to its transverse dimension or width of about 100:1 or greater.

2. The system of claim 1 wherein said elongated orifice is continuous.

3. The system of claim 2 wherein said continuous, elongated orifice is annular.

4. The system of claim 3 wherein said second member comprises a Belleville washer, said first member comprises a Belleville washer seat, and said Belleville washer is resiliently biased toward said first member.

5. The system of claim 3 wherein said ratio is in the range of from about 200 to about 20,000 and said transverse dimension is in the range of from about 10 to about 1,250 micrometers.

6. The system of claim 4 wherein said Belleville washer and said Belleville washer seat are comprised of stainless steel.

7. The system of claim 1 further comprising a housing for said first and second members.

8. The system of claim 1 wherein said second member is biased toward said first member by a pneumatically-actuated or hydraulic piston.

9. The system of claim 1 further comprising at least a second pair of first and second members in stacked, repeating relationship to the first pair of said first and second members.

10. The system of claim 9 wherein said elongated orifice is continuous and annular, said first member of each of said pairs comprises a Belleville washer seat and said second member of each of said pairs comprises a Belleville washer resiliently biased toward its respective Belleville washer seat.

11. The system of claim 10 further comprising a housing for said pairs of first and second members.

12. The system of claim 11 wherein said system further comprises a third, fourth and fifth pair of said first and second members in stacked, repeating relationship to each other and to said first pair and said second pair of said first and second members.

13. The system of claim 11 wherein said ratio of each of the elongated orifices formed between each pair of said first and second members at said pressure is in the range of from about 200 to 20,000 and the transverse dimensions or widths of said elongated orifices are in the range of from about 10 to about 1,250 micrometers.

14. The system of claim 11 wherein said Belleville washers are comprised of stainless steel and have a nominal, uncompressed, outside diameter of about 2.5 inches.

15. A method for dispersing aggregates in an aggregate-containing fluid medium employing a self-cleaning system for dispersing aggregrates ina fluid medium which system includes first and second members operatively associated to form an internal chamber and having an inlet to said chamber for admitting said fluid, and with at least one of said members resiliently biased toward the other, said method comprising the steps: (a) introducing said fluid medium into said chamber through said inlet under a pressure in the range of from about 50 to about 1,000 psid, the pressurized fluid deforming said at least one of said members to provide an elongated orifice between said first and second members for egress of fluid medium from said system, said elongated orifice under said pressure haivng a minimum length of about 3 inches, a transverse dimension or width in the range of from about 1 to about 1,500 micrometers and a ratio of its length to its transverse dimension or width of about 100:1 or greater and (b) passing said fluid medium through said elongated orifice, thereby dispersing said aggregate in said fluid medium.

16. The method of claim 15 wherein said pressure is in the range of from about 100 to about 800 psid.

17. The method of claim 16 wherein said aggregate-containing fluid medium comprises a viscosified well completion fluid.

18. The method of claim 16 wherein said aggregate-containing fluid medium comprises hydroxyethyl-cellulose at a concentration of from about 0.25 to about 1 percent by weight in an aqueous based fluid medium and normalized viscosity of the fluid medium after passage through said system is at least about 90 percent of the normalized viscosity of the untreated fluid medium.

19. The method of claim 18 wherein said fluid medium is a well completion fluid and said fluid medium containing dispersed aggregate after passage through said elongated orifice is diluted and filtered and the resulting effluent is injected into a well formation.

20. The method of claim 15 wherein said aggregate-containing fluid medium comprises metallic oxide particles and a resin system and said pressure is in the range of from about 300 to 800 psid.

21. The method of claim 15 wherein said aggregate-containing fluid medium comprises a pigment.

22. The method of claim 15 wherein said aggregate-containing fluid medium comprises carbon black.

23. The method of claim 15 wherein said self-cleaning system further includes at least a second pair of first and second members in stacked, reapeating relationship to the first pair of said first and second members.

24. The method claim 23 wherein said pressure is in the range of from about 100 to about 800 psid.

25. The method of claim 23 wherein siad aggregate-containing fluid medium comprises hydroxyethyl-cellulose at a concentration of from about 0.25 to about 1 percent by weight in an aqueous based fluid medium and the normalized viscosity of the fluid medium containing dispersed aggregate after passage through said elongated orifice is at least about 90 percent of the normalized viscosity of the untreated fluid medium.

26. The method of claim 23 wherein said fluid medium is a well completion fluid and said fluid after passage through said elongated oriifice is diluted and filtered and the resulting effluent is injected into a well formation.

27. The method of claim 23 wherein said aggregate-containing fluid medium comprises metallic oxide particles and a resin system and said pressure is in the range of from about 300 to 800 psid.

28. The method of claim 23 wherein said aggregate-containing fluid medium comprises a pigment.

29. The method of claim 23 wherein said aggregate-containing fluid medium comprises carbon black.

30. A method for dispersing aggregates in an aggregate-containing fluid medium comprising passing said medium at a pressure in the range of from about 50 to about 1,000 psid through an elongated, self-cleaning orifice, said orifice having a length of at least about 3 inches and a length to width or transverse dimension ratio of 100:1 or greater and wherein the structure defining said elongated orifice comprises first and second members with at least one of said members resiliently biased toward the other to provide self-cleaning.

31. The method of claim 15 wherein said second member comprises a Belleville washer, said first member comprises a Belleville washer seat, and said Belleville washer is resiliently biased toward said first member.

32. The method of claim 19 wherein said ratio is in the range of from about 200 to about 20,000 and said transverse dimension is in the range of from about 10 to about 1,250 micrometers.

33. The method of claim 23 wherein said elongated orifice is continuous and annular, said first member of each of said pairs comprises a Belleville washer seat, said second member of each of said pairs comprises a Belleville washer resiliently biased toward its respective Belleville washer seat and a housing is provided for said pairs of first and second members.

34. The method of claim 33 wherein said system further comprises a third, fourth and fifth pair of said first and second members in stacked, repeating relationship to each other and to said first pair and said second pair of said first and second members.

35. The method of claim 33 wherein said ratio of each of the elongated orifices formed between each pair of said first and second members at said pressure is in the range of from about 200 to 20,000 and the transverse dimensions or widths of said elongated orifices are in the range of from about 10 to about 1,250 micrometers.

36. The method of claim 33 wherein said Belleville washers are comprised of stainless steel and have a nominal, uncompressed, outside diameter of about 2.5 inches.

* * * * *